US010682558B2

(12) United States Patent
Thompson

(10) Patent No.: US 10,682,558 B2
(45) Date of Patent: Jun. 16, 2020

(54) TRAINING APPARATUS, SYSTEM AND METHOD FOR CONTACT SPORTS

(71) Applicant: J. Ken Thompson, Mountain Brook, AL (US)

(72) Inventor: J. Ken Thompson, Mountain Brook, AL (US)

( * ) Notice: Subject to any disclaimer, the term of this patent is extended or adjusted under 35 U.S.C. 154(b) by 0 days.

(21) Appl. No.: 16/419,965

(22) Filed: May 22, 2019

(65) Prior Publication Data

US 2019/0358510 A1 Nov. 28, 2019

Related U.S. Application Data

(60) Provisional application No. 62/675,822, filed on May 24, 2018.

(51) Int. Cl.

| | |
|---|---|
| ***A63B 69/00*** | (2006.01) |
| ***A63B 69/34*** | (2006.01) |
| ***A42B 3/04*** | (2006.01) |
| *A42B 3/20* | (2006.01) |
| *A63B 71/06* | (2006.01) |

(52) U.S. Cl.

CPC ..... *A63B 69/002* (2013.01); *A42B 3/046* (2013.01); *A42B 3/0473* (2013.01); *A42B 3/20* (2013.01); *A63B 71/0622* (2013.01)

(58) Field of Classification Search

CPC ... A63B 69/002; A63B 69/0028; A63B 71/10; A63B 71/0622; A42B 3/0473; A42B 3/046; A42B 3/20; A61F 5/055; A41D 1/04; A61B 5/4064; A61B 5/11

USPC ..... 473/422, 458, 464, 450, 438, 446, 441; 2/411–415, 421–425, 468

See application file for complete search history.

(56) References Cited

U.S. PATENT DOCUMENTS

| | | | | |
|---|---|---|---|---|
| 3,148,375 A | | 9/1964 | Jones | |
| 3,671,974 A | | 6/1972 | Sims | |
| 3,697,065 A | * | 10/1972 | Glassburner, Jr. | A63B 69/0028 473/208 |
| 3,818,509 A | | 6/1974 | Romo et al. | |
| 3,873,996 A | * | 4/1975 | Varteressian | A42B 3/0473 2/421 |
| 3,900,896 A | * | 8/1975 | Ackerman | A42B 3/0473 2/468 |
| 4,319,362 A | * | 3/1982 | Ettinger | A63B 71/10 2/415 |
| 4,947,490 A | * | 8/1990 | Hayden | A42B 3/20 2/424 |

(Continued)

OTHER PUBLICATIONS

Heck et al.; National Athletic Trainer's Association Position Statement: Head-Down Contact & Spearing in Tackle Football; Journal of Athletic Training; 2004; pp. 101-111; vol. 39(1); National Athletic Trainers' Association, Inc.

*Primary Examiner* — Mitra Aryanpour
(74) *Attorney, Agent, or Firm* — Gardner Groff & Greenwald, PC

(57) ABSTRACT

A training apparatus, system and method for teaching proper athletic technique in contact sports. A first strap portion may be attached to a football helmet, and a second strap portion attached to shoulder pads. The apparatus provides feedback on the user's technique as tension is applied to the first and second strap portions, for example when the user attempts to lower their head during tackling or blocking, and causing detachment upon exceeding a threshold detachment force.

27 Claims, 5 Drawing Sheets

(56) References Cited

U.S. PATENT DOCUMENTS 5,123,408 A * 6/1992 Gaines ..... A42B 3/0473 2/425
5,261,125 A * 11/1993 Cartwright ..... A42B 3/0473 2/421
5,437,613 A * 8/1995 Reggio ..... A42B 3/0473 2/425
5,517,699 A * 5/1996 Abraham, II ..... A42B 3/0473 2/205
6,810,535 B1 * 11/2004 Moloney ..... A42B 3/0473 2/411
6,971,123 B2 * 12/2005 Weaver ..... A42B 3/0473 2/411
8,074,301 B2 12/2011 Mothaffar
8,341,770 B2 1/2013 Siegler et al.
8,528,113 B2 9/2013 Siegler et al.
8,834,394 B2 * 9/2014 Ghajar ..... A61F 5/055 128/846
8,914,918 B2 * 12/2014 Swanson ..... A41D 1/04 2/468
8,918,918 B2 12/2014 Jackson
8,961,440 B2 * 2/2015 Huang ..... A61B 5/4064 600/587
9,603,404 B2 * 3/2017 Pocatko ..... A42B 3/0473 2/421
9,826,792 B2 * 11/2017 Dowd ..... A42B 3/185 2/422
10,111,485 B2 * 10/2018 Nagely ..... A42B 3/0473 2/468
2004/0055077 A1 3/2004 Wright
2004/0068779 A1 * 4/2004 Duffy ..... B62J 99/00 2/422
2013/0205480 A1 * 8/2013 Nagely ..... A63B 71/1291 2/425
2017/0318889 A1 * 11/2017 Nagely ..... A42B 3/0473 2/468

* cited by examiner

TRAINING APPARATUS, SYSTEM AND METHOD FOR CONTACT SPORTS

CROSS-REFERENCE TO RELATED APPLICATION

This application claims the benefit of U.S. Provisional Patent Application Ser. No. 62/675,822 filed May 24, 2018, the entirety of which is hereby incorporated herein by reference for all purposes.

TECHNICAL FIELD

The present invention relates generally to the field of athletic training, and more particularly to a training apparatus and method for improved safety and training proper technique in contact sports, such as tackling and blocking in American football, lacrosse, hockey and other sports.

BACKGROUND

The head's role in blocking and tackling in the sport of football has been the subject of concern for decades. Spearing—the act of one player intentionally driving the top their helmet into another player—was once allowed. But in 1976, after athletes suffered injuries including spinal cord injuries, the NCAA and National Federation of State High School Associations banned the practice. Safety concerns relating to tackling in football continue, however. Serious neck/spinal cord injuries from tackle football are often caused by axial loading as a result of head-down contact. For that reason, current considerations of proper football blocking and tackling technique direct that the player's head should remain upright or erect at the point of contact. See, e.g., Heck, Clarke, Peterson, Torg & Weis, *National Athletic Trainers' Association Position Statement: Head-Down Contact and Spearing in Tackle Football*, Journal of athletic Training, 39(1), 101-111 (2004).

Proper technique and positioning is important for safe participation in many contact sports, including without limitation, American football, rugby, hockey, lacrosse, and other sports. Training of proper heads-up tackling and blocking technique, however, is not well supported by any known device or apparatus. It has now been recognized that a need exists for a way to train athletes in proper "heads-up" tackling and blocking technique. It is to the provision of a training apparatus and method for training athletes proper "heads-up" technique in football tackling and blocking, and in other contact sports and activities, meeting these and other needs that the present invention is primarily directed.

SUMMARY

In example embodiments, the present invention provides a training apparatus and method by which athletes can learn proper football tackling and blocking technique, and proper technique for contact in various other sports. In example forms, the apparatus and method enable training to be enhanced by developing biofeedback, proprioception and muscle memory for a safer heads-up tackling and blocking technique. The apparatus and method may be used to teach youth football players, and players of other sports, to resist the natural tendency toward downward head movement at the point of contact when blocking and tackling. Repetitive awareness of proper positioning and downward movement of the head when tackling and blocking, and/or real-time feedback indicating when improper technique has been used, will help train participants in proper technique.

In example embodiments, the apparatus consists of two nylon straps or segments. One strap or segment is affixed to the rear interior or exterior of the shell of a helmet or other headgear. The second strap or segment is affixed to the rear interior or exterior shell of the shoulder pads or other gear on the player's torso. The straps may be affixed to the helmet and shoulder pads, or to other gear or apparel, by means of detachable hook-and-loop attachment material, snaps, stitching, clips, or by other permanent or detachable attachment means. The straps are then coupled to one another, for example by means of male and female buckles or other couplings. The male and/or female buckle optionally includes an adjustment mechanism that allows for setting the proper range of forward movement of the head without any noticeable resistance being applied. In example embodiments, the coupling is configured to release or detach upon application of a specified tension force on the straps, for example when the wearer lowers their head upon making contact using improper tackling or blocking technique. In this manner, release of the coupling provides tactile, visual, and/or audible feedback to the wearer and/or to others (coaches, teammates, etc.) of improper technique. In further example embodiments, the coupling may provide a measure of resistance to the wearer lowering their head into an improper contact position, thereby providing feedback.

In one aspect, the present invention relates to a training apparatus for teaching a user proper athletic technique. The training apparatus preferably includes a first tether portion for attachment to a first piece of gear (for example, headgear) worn by the user, and a second tether portion for attachment to a second piece of gear worn by the user (for example, shoulder pads or other gear worn on the torso or elsewhere below the head).

In another aspect, the invention relates to a training system. The training system preferably includes a first piece of athletic protective gear configured to be worn on a user's head, a second piece of athletic protective gear configured to be worn below a user's head, and a training apparatus including a first tether portion for attachment to the first piece of athletic protective gear, and a second tether portion for attachment to the second piece of athletic protective gear. In use, the training apparatus preferably provides feedback to the user to resist lowering of the user's head during contact.

In still another aspect, the invention relates to a training method. The training method preferably includes affixing a first strap portion to a first piece of athletic gear configured to be worn by a user, affixing a second strap portion to a second piece of athletic gear configured to be worn by the user, and providing feedback to the user due to tension applied between the first and second strap portions in the event the user attempts a non-preferred movement, and/or by release of a coupling between the first and second strap portions to indicate the occurrence of a non-preferred movement.

In another aspect, the invention relates to a training apparatus for teaching proper technique in a contact sport. The training apparatus preferably includes a first tether portion for attachment to a first piece of gear worn by a user, a second tether portion for attachment to a second piece of gear worn by the user, and detachable coupling means configured to remain attached when the user engages in proper technique and to detach upon application of a threshold detachment force when the user engages in improper technique.

In another aspect, the invention relates to a training system preferably including a first piece of athletic protective gear configured to be worn on a user's head; a second piece of athletic protective gear configured to be worn below a user's head; and a training apparatus comprising a first tether portion for attachment to the first piece of athletic protective gear, a second tether portion for attachment to the second piece of athletic protective gear, and detachable coupling means configured to remain attached when the user engages in proper technique, and to detach when the user engages in improper technique, thereby providing feedback indicating proper or improper technique.

In yet another aspect, the invention relates to a training method for teaching proper technique in a contact sport. The training method preferably includes affixing a first portion of a training apparatus to a first piece of athletic gear worn on a head of a user; affixing a second portion of a training apparatus to a second piece of athletic gear worn below the head of the user; and providing feedback in the form of a first configuration of the training apparatus upon the user engaging in a proper technique, and in the form of a second configuration of the training apparatus upon the user engaging in an improper technique.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

Figure 2:
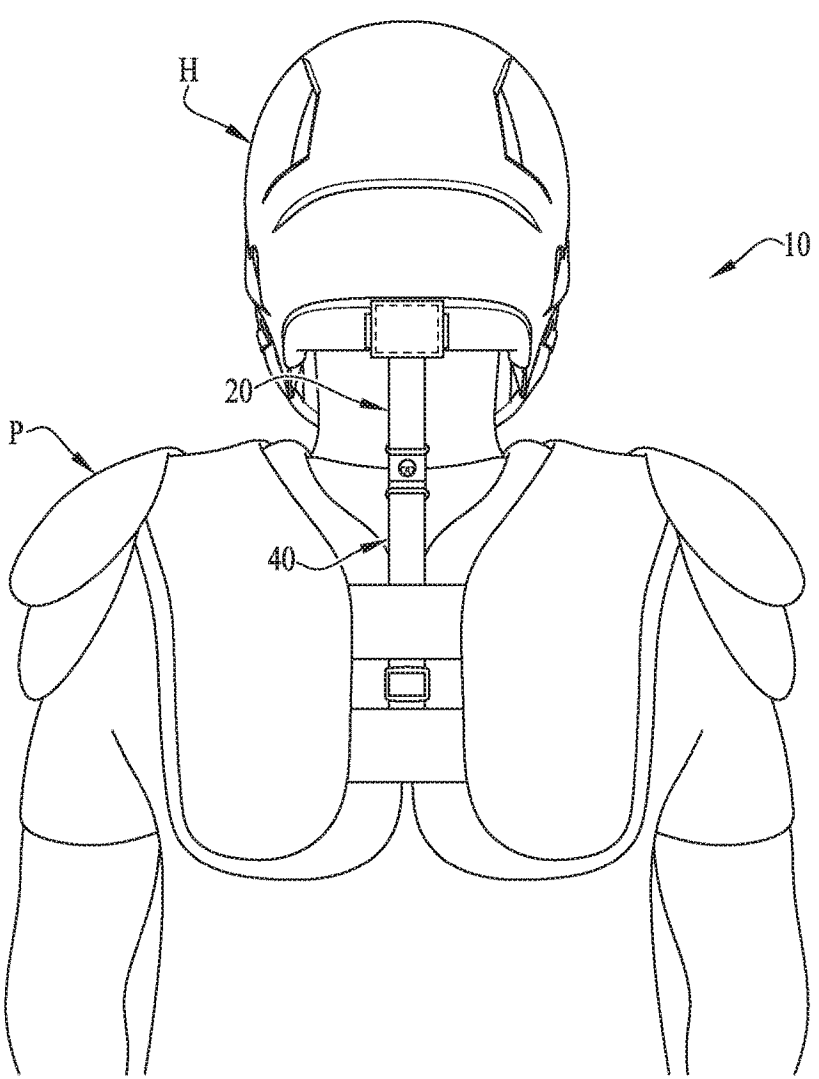
FIG. 2 is a rear view of the training apparatus and system of FIG. 1.

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-6 show example embodiments of a training apparatus 10 adapted to use in a method of training athletes proper contact technique, for example a proper heads-up football tackling and blocking technique. The apparatus 10 includes a first or upper strap or flexible tether portion 20 for attachment to a first piece of protective gear such as a football helmet or other headgear H, and a second or lower strap or flexible tether portion 40 for attachment to a second piece of protective gear such as a set of football shoulder pads P or other gear or garments worn on the torso or below the head.

The first or upper strap portion 20 includes a length of flexible webbing 22, a female side-release buckle component 24 affixed to one end of the webbing, and a helmet or headgear attachment panel 26 affixed to the opposite end of the webbing. In example embodiments, the webbing 22 is a piece of woven polypropylene, nylon, or other natural or synthetic material webbing or strap material, for example having a width of about 1" and a length of about 2"-6", for example about 3". In example embodiments, the female buckle component 24 is a molded plastic part having a mounting slot through which the webbing 22 is looped and stitched to secure the female buckle component to the webbing. The female buckle component 24 includes an end opening or receiver for cooperative engagement with a complementary male buckle portion. In example embodiments, the helmet attachment panel 26 comprises a piece of webbing or fabric, for example a 1½"-2" piece of woven polypropylene, nylon, or other natural or synthetic material webbing or fabric, stitched or otherwise attached to the webbing 22, and having a piece of hook-and-loop fastener material (e.g., Velcro) attachment material attached by stitching or otherwise applied to one side. Alternatively, the helmet attachment panel 26 can comprise a portion of the webbing 22, to which the hook-and-loop material is applied.

The second or lower strap portion 40 includes a length of flexible webbing 42, a male buckle component 44 affixed to one end of the webbing, and a pads attachment panel 46 affixed to the opposite end of the webbing. In example embodiments, the webbing 42 is a piece of woven polypropylene, nylon, or other natural or synthetic material webbing, preferably of matching or similar material to webbing 22, for example having a width of about 1" and a length of about 4" to about 10", for example about 8". In example embodiments, the male buckle component 44 is a molded plastic part having a double-slotted strap-length-adjustment slider or coupling 45 through which the webbing 42 is looped and retained to secure the male buckle component to the webbing and allow adjustment of the length of the strap portion 40. In example forms, the male buckle component 44 also includes two flexible center prongs adapted for cooperative and selectively releasable engagement with the female buckle component 24 in typical fashion. In example embodiments, the pads attachment panel 46 is of similar construction to that of the helmet attachment panel 26, including a piece of webbing or fabric, for example a 1½"-2" piece of woven polypropylene, nylon, or other natural or synthetic material webbing or fabric, stitched or otherwise attached to the webbing 42, and having a piece of hook-and-loop fastener material (e.g., Velcro) attachment material attached by stitching or otherwise applied to one side. Alternatively, the pads attachment panel 46 can comprise a portion of the webbing 42, to which the hook-and-loop material is applied. In example embodiments, the helmet attachment panel 26 includes one of the hook-and-loop material components (for example the loop component), and the pads attachment panel 46 includes the other hook-and-loop material component (for example the hook component). The releasable attachment of the hook-and-loop coupling material attaching the apparatus 10 to the helmet H and the pads P enables the apparatus to be removed from the equipment for actual games, or when the feedback is not required or desired. In alternative embodiments, the first and second strap portions 20, 40 can be different ends or portions of a single, unitary piece of strap or webbing; or can be releasably attached to one another by other types of buckles, snaps, couplings, hook-and-loop attachment, or other releasable attachment means; or can be permanently or semi-permanently attached to one another by stitching, adhesive, or other permanent or semi-permanent attachment means.

In example embodiments, the female buckle or coupling component 24 and the male buckle or coupling component 44 are cooperatively mating components of a safety release clasp or coupling, configured to release or decouple from one another upon application of a threshold detachment force applied by tension upon the first and second strap portions 20, 40 being pulled in opposite directions, away from one another. In example forms, the safety release clasp or coupling detaches upon application of a threshold detachment force of between 4-10 lbs., for example between about 5-7 lbs., and in particular examples about 6 lbs. In alternate embodiments, other releasable coupling configurations may be utilized, such as snap couplings, interengaging hook-and-loop attachment material, perforated tether material, or other detachable coupling means between the first and second strap portions 20, 40 and/or between the helmet or other headgear H and the pads or other body gear P, configured to release or decouple upon application of a predetermined threshold detachment force.

Figure 7:
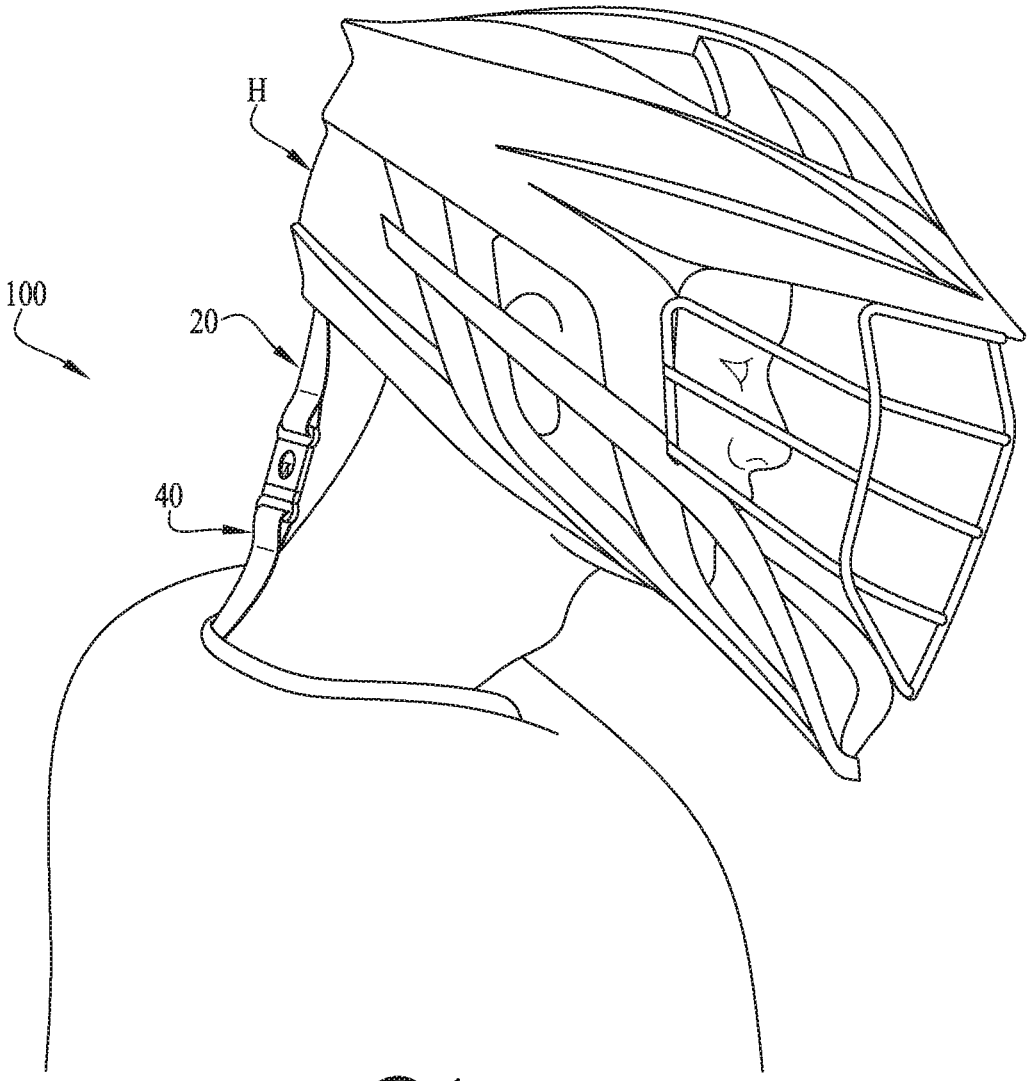
FIG. 7 shows a side view of a training apparatus and system according to another example embodiment of the present invention.

In use, the first or upper strap portion 20 is attached to a first piece of equipment or gear worn by a user, such as a football helmet or other headgear H, and the second or lower strap portion 40 is attached to a second piece of equipment or gear worn by the user, such as a set of football shoulder pads or other torso or body gear P worn below the head. For example, the helmet attachment panel 26 of the first or upper strap portion 20 can be affixed to a helmet mounting tab 60 affixed to the inside or outside of the helmet H, and the pads attachment panel 46 of the second or lower strap portion 40 can be affixed to a pads mounting tab 62 affixed to the upper back or neck area of the pads P. In example embodiments, the helmet mounting tab 60 and the pads mounting tab 62 include the opposite hook and loop material component as do those of the helmet attachment panel 26 and pads attachment panel 46, respectively. The helmet mounting tab 60 and the pads mounting tab 62 may be permanently or removably affixed to the helmet H and pads P, respectively, for example by adhesive, stitching, snap or other coupling or attachment means. In alternative embodiments, the apparatus 10 may be configured for use in training other athletic techniques for different sports. For example, strap or tether portions may be configured for attachment to a hockey or lacrosse helmet (see FIG. 7) and pads for training in checking and blocking, to headgear and a jersey collar or shorts waistband for rugby tackling training, etc.

Figure 1:
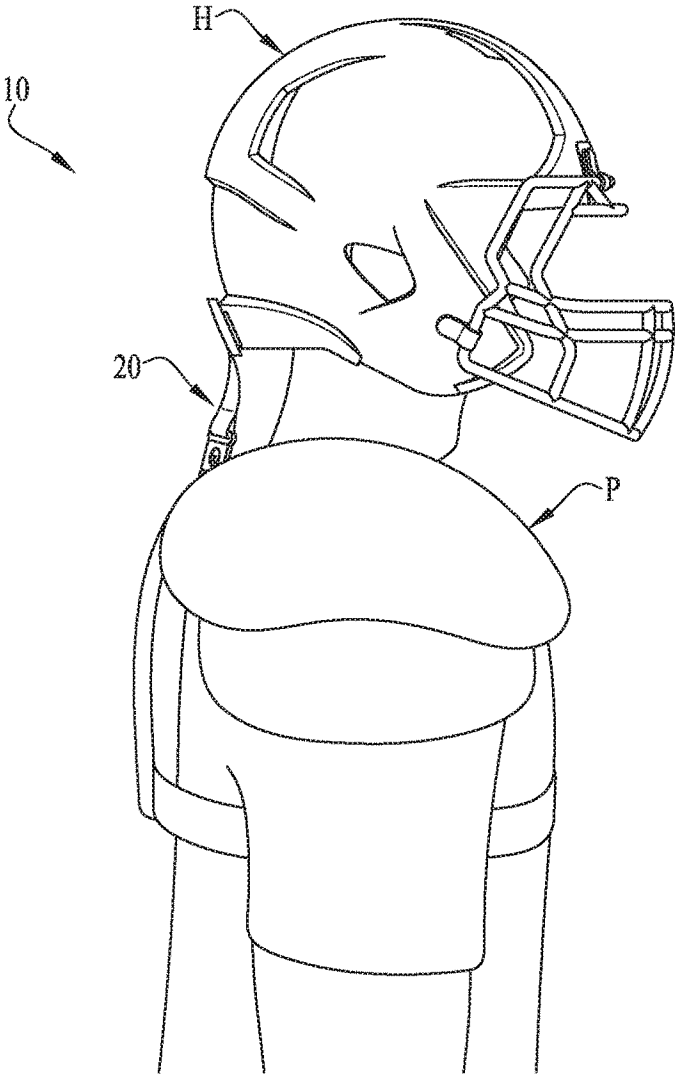
FIG. 1 is a side view showing a training apparatus and system according to an example embodiment of the present invention.
Figure 6:
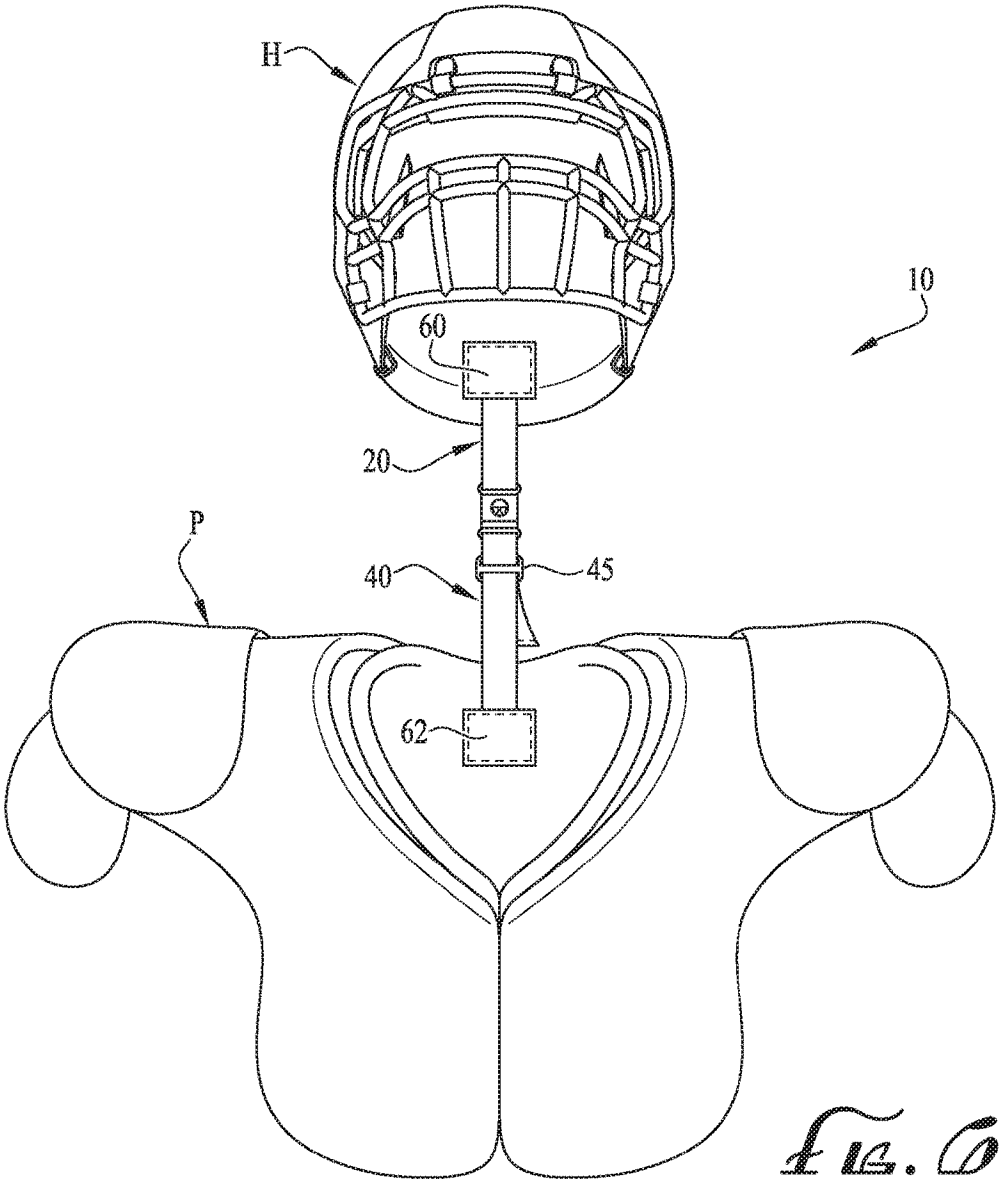
FIG. 6 shows a training system incorporating the training apparatus of FIG. 5 in place on a helmet and shoulder pads, with the first and second portions coupled in a ready for use configuration.
Figure 5:
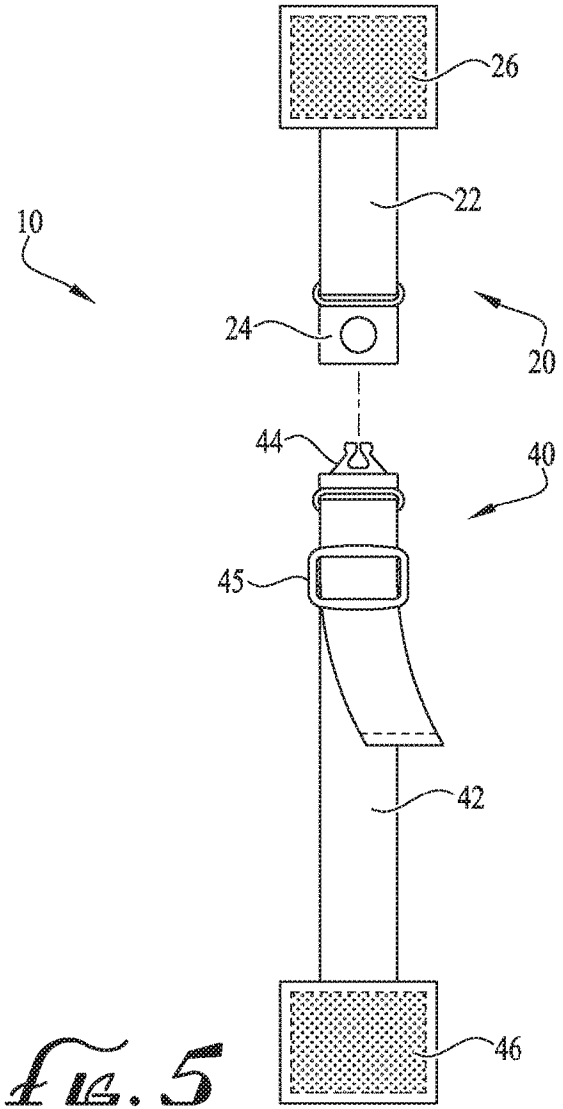
FIG. 5 shows a detailed view of a training apparatus according to an example embodiment of the present invention, with a coupling between first and second portions of the apparatus decoupled or detached.

In an example method of training using the apparatus 10, the first or upper strap portion 20 is attached to a football helmet H, and the second or lower strap portion 40 is attached to a set of football shoulder pads P, as shown in FIGS. 1, 2 and 6. A user or wearer, such as a young person or athlete then dons the helmet H and pads P in standard form, with the male and female buckle portions 44, 24 detached from one another. The user or a coach then connects the male and female buckle portions 44, 24 to one another. The effective length of the apparatus is adjusted to fit the user by tightening or loosening the straps at the coupling or elsewhere. In example applications, the length is adjusted to be just long enough for the wearer to look down and see the toes of their shoes, but not allowing the wearer to lower their head further without decoupling the safety release clasp or coupling components 24, 44. In example embodiments, the length is adjusted to cause the safety release clasp or coupling components 24, 44 to decouple at a maximum head lowering angle of about 15°, or for example a maximum head lowering angle of about 10°-20°, relative to the wearer's torso or an axis between the backs of the hips and the shoulder blades.

Figure 3:
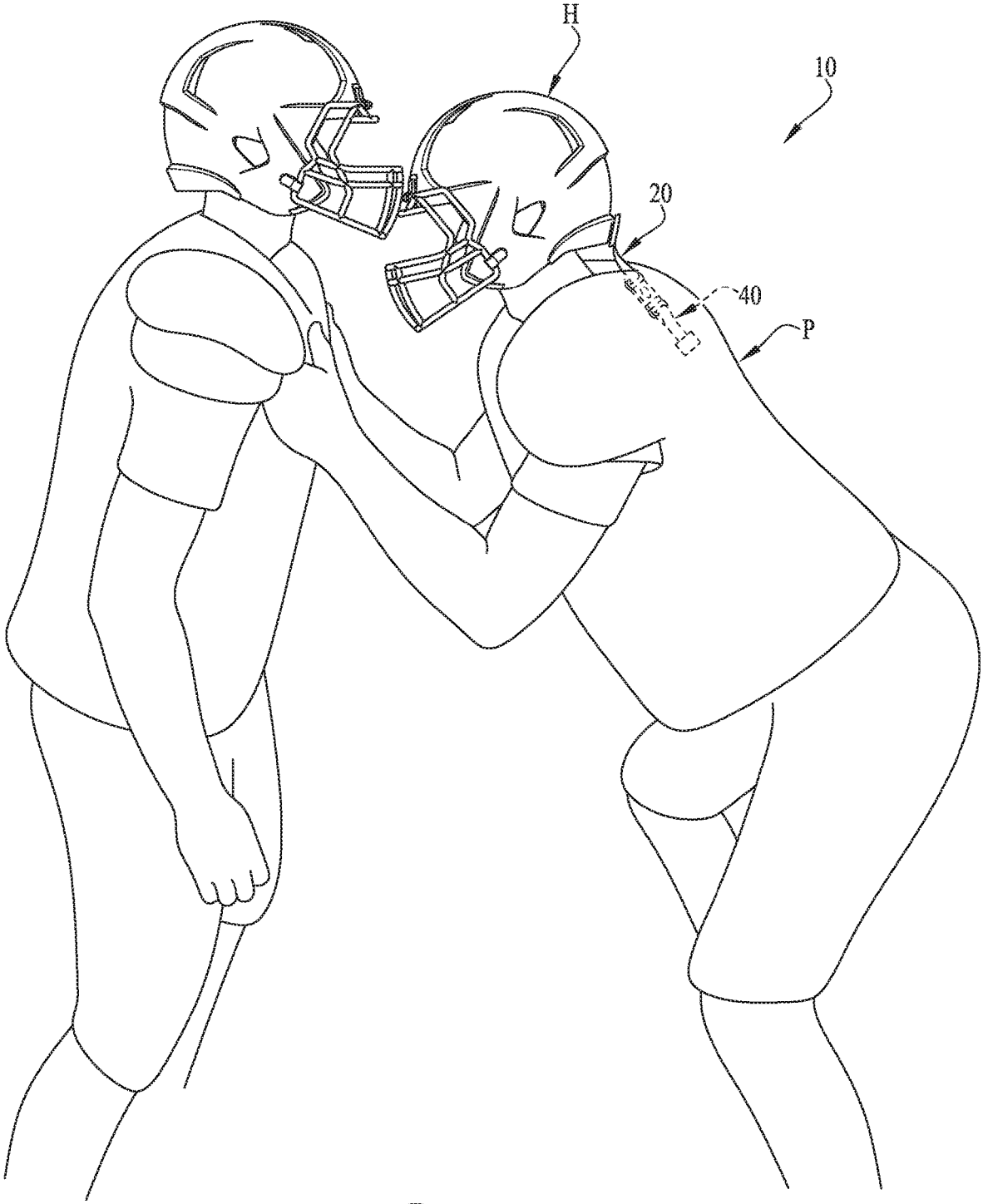
FIG. 3 shows a participant engaged in contact with another participant, with the apparatus and system of FIG. 1 coupled, while a proper heads-up contact technique is maintained.
Figure 4:
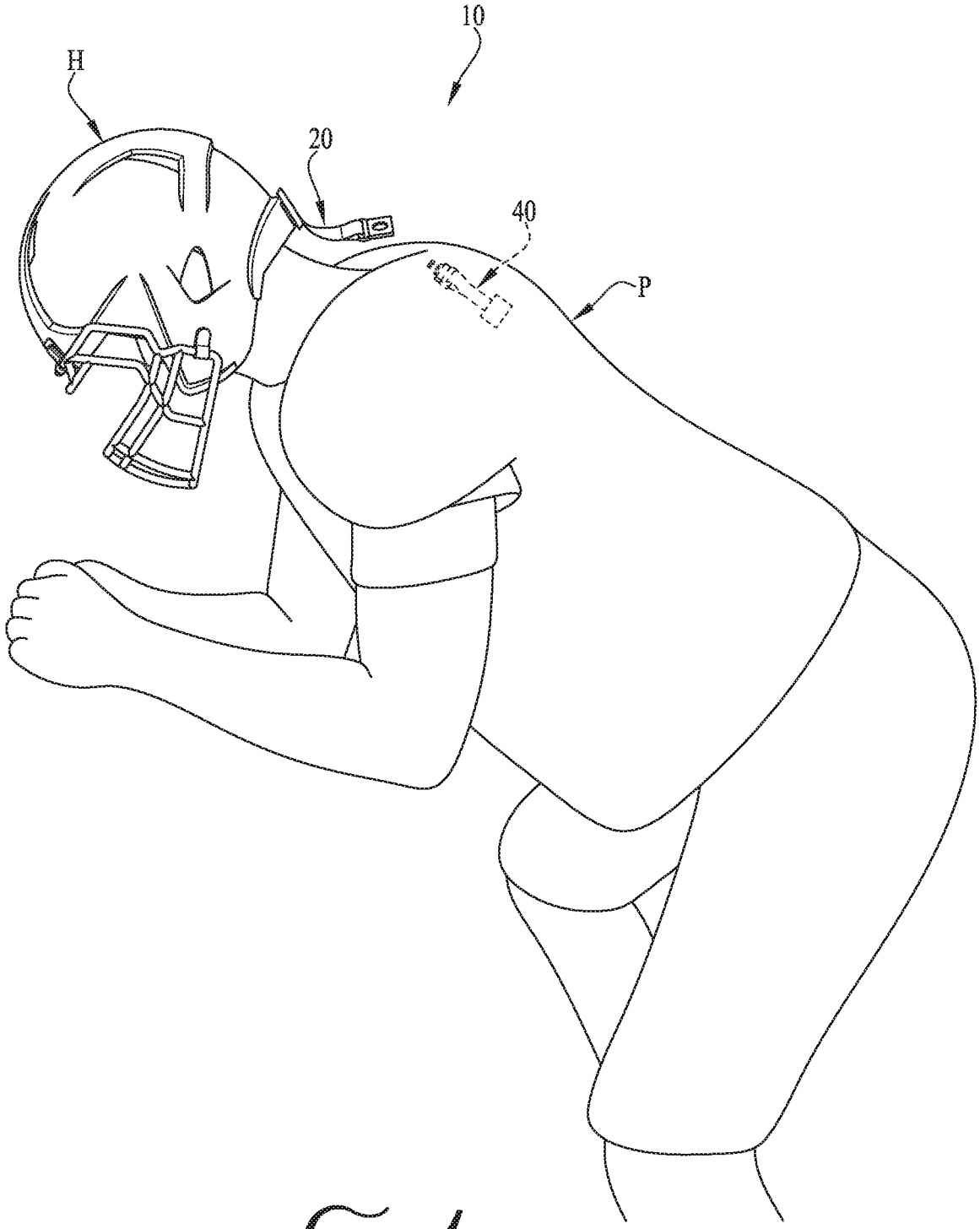
FIG. 4 shows the training apparatus and system, with a coupling between first and second portions detached, indicating an improper head-down position has occurred.

The user then participates in practice or drills involving the teaching of proper contact technique, for example proper heads-up football tackling and blocking techniques (see FIG. 3). If the user attempts to lower their head (as may be instinctual) in the process of tackling or blocking another player, the connection of the apparatus 10 between the helmet H and pads P resists the head-lowering motion due to tension applied between the first and second strap portions 20, 40, providing sensory feedback to the user reminding them to practice a safer and more proper heads-up technique. If the user continues to lower their head to a point where a tensile force exceeding the threshold detachment force is applied, the components of the safety release clasp or coupling 24, 44 detach from one another (see FIG. 4), providing sensory and audible feedback to the user, and visual feedback to coaches or teammates, indicating that improper technique has been used, and inviting a coach or other participant to teach proper technique. With repeated practice, the user develops a more proper athletic form, which is reinforced by muscle memory over time.

In example embodiments, the safety release clasp or coupling is selected to detach upon application of a predetermined or desired threshold detachment force, which may vary depending on the age, size and/or development level of the user. In further alternate embodiments, the safety release clasp or coupling may allow adjustment of the threshold detachment force at which its components 24, 44 release or decouple. In still further alternate embodiments, the releasable attachment of the hook-and-loop coupling material 26, 46 attaching the apparatus 10 to the helmet H and/or the pads P may provide feedback instead of or in addition to the provision of a safety release clasp or coupling. For example, the coupling elements 24, 44 may be configured to remain coupled or alternatively may be omitted, and one or both of the attachment panels 26, 46 may detach from the helmet H and/or pads P when the user lowers their head into an improper contact position. Optionally, the strength of the attachment provided by the hook-and-loop material may be varied to suit the desired level of feedback and/or the size and development level of the user, by varying the size of the attachment panels 26, 46 and/or the type of hook-and-loop material used. In example embodiments, the attachment strength may be controlled to cause release upon application of a threshold force, for safety or training purposes. When the training is complete, the male and female buckle portions 44, 24 may be disconnected from one another, and the helmet H and pads P can be removed in standard fashion. Additionally, the first and/or second strap portions 20, 40 may optionally incorporate a greater or lesser degree of elasticity to provide increasing resistance when the apparatus 10 is placed in tension as the user attempts to lower their head, or may be substantially inelastic to provide a more abrupt resistance as tension is applied.

While the invention has been described with reference to example embodiments, it will be understood by those skilled in the art that a variety of modifications, additions and deletions are within the scope of the invention, as defined by the following claims.

What is claimed is:

1. A training apparatus for teaching proper technique in a contact sport, the training apparatus comprising:

a first tether portion for attachment to a first piece of gear worn by a user;

a second tether portion for attachment to a second piece of gear worn by the user; and detachable coupling means configured to remain attached when the user engages in proper technique, and to detach upon application of a threshold detachment force in tension between the first and second tether portions when the user engages in improper technique, whereby detachment of the detachable coupling means provides sensory feedback for the user to practice proper technique.

2. The training apparatus of claim 1, wherein the first piece of gear comprises headgear, and wherein the second piece of gear comprises gear worn on the user's body below the head.

3. The training apparatus of claim 2, wherein the first piece of gear comprises a helmet and the second piece of gear comprises shoulder pads.

4. The training apparatus of claim 1, wherein the detachable coupling means comprises a safety release coupling having interengaging first and second coupling components configured to decouple from one another upon application of the threshold detachment force.

5. The training apparatus of claim 1, wherein the detachable coupling means comprises hook-and-loop attachment material.

6. The training apparatus of claim 1, wherein the threshold detachment force is between 4-10 pounds.

7. The training apparatus of claim 6, wherein the threshold detachment force is between 5-7 pounds.

8. The training apparatus of claim 1, wherein the first tether portion comprises releasable attachment means for attachment to the first piece of gear.

9. The training apparatus of claim 8, wherein the releasable attachment means comprises hook-and-loop attachment material.

10. The training apparatus of claim 1, wherein the second tether portion comprises releasable attachment means for attachment to the second piece of gear.

11. The training apparatus of claim 10, wherein the releasable attachment means comprises hook-and-loop attachment material.

12. The training apparatus of claim 1, further comprising length adjustment means.

13. A training system comprising:

a first piece of athletic protective gear configured to be worn on a user's head;

a second piece of athletic protective gear configured to be worn below a user's head; and a training apparatus comprising a first tether portion for attachment to the first piece of athletic protective gear, a second tether portion for attachment to the second piece of athletic protective gear, and detachable coupling means configured to remain attached when the user engages in proper technique, and to detach upon application of a threshold detachment force in tension between the first and second tether portions when the user engages in improper technique, thereby providing feedback indicating proper or improper technique.

14. The training system of claim 13, wherein the first piece of athletic protective gear comprises headgear, and wherein the second piece of athletic protective gear comprises gear worn on the user's body below the head.

15. The training system of claim 14, wherein the first piece of gear comprises a helmet and the second piece of gear comprises shoulder pads.

16. The training system of claim 13, wherein the detachable coupling means comprises a safety release coupling having interengaging first and second coupling components configured to decouple from one another upon application of the threshold detachment force.

17. The training system of claim 16, wherein the threshold detachment force is between 4-10 pounds.

18. The training system of claim 17, wherein the threshold detachment force is between 5-7 pounds.

19. The training system of claim 13, wherein the detachable coupling means comprises hook-and-loop attachment material.

20. The training system of claim 13, wherein the first tether portion comprises releasable attachment means for attachment to the first piece of athletic protective gear.

21. The training system of claim 20, wherein the releasable attachment means comprises hook-and-loop attachment material.

22. The training system of claim 13, wherein the second tether portion comprises releasable attachment means for attachment to the second piece of athletic protective gear.

23. The training system of claim 22, wherein the releasable attachment means comprises hook-and-loop attachment material.

24. The training system of claim 13, wherein the training apparatus further comprises length adjustment means.

25. A training method for teaching proper technique in a contact sport, the training method comprising:

affixing a first portion of a training apparatus to a first piece of athletic gear worn on a head of a user;

affixing a second portion of a training apparatus to a second piece of athletic gear worn below the head of the user;

coupling a detachable coupling means between the first and second portions of the training apparatus; and providing feedback in the form of a first configuration of the training apparatus wherein the detachable coupling means remains attached upon the user engaging in a proper technique, and in the form of a second configuration of the training apparatus wherein the detachable coupling means detaches upon application of a threshold detachment force in tension between the first and second portions of the training apparatus upon the user engaging in an improper technique.

26. The training method of claim 25, wherein the proper technique comprises the user maintaining a heads-up contact position, and the improper technique comprises a lowering of the head by the user beyond a specified maximum head lowering angle.

27. The training method of claim 25, wherein the first configuration of the training apparatus comprises detachable portions of the training apparatus remaining engaged with one another, and wherein the second configuration of the training apparatus comprises disengagement of the detachable portions of the training apparatus from one another.

* * * * *